US006672209B1

(12) United States Patent
Charette et al.

(10) Patent No.: US 6,672,209 B1
(45) Date of Patent: Jan. 6, 2004

(54) METHOD FOR MAGNETICALLY TUCKING A PRINTING PLATE INTO A PLATE CYLINDER

(75) Inventors: William Albert Charette, Rollinsford, NH (US); Michael Robert Lamelin, Madbury, NH (US); Lev Zlatin, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/213,534

(22) Filed: Aug. 6, 2002

(51) Int. Cl.[7] ..... B41F 27/02; B41F 27/12
(52) U.S. Cl. ..... 101/415.1; 101/477; 101/479
(58) Field of Search ..... 101/415.1, 477, 101/389.1, 378, 479, 480

(56) References Cited

U.S. PATENT DOCUMENTS 4,878,429 A * 11/1989 Russo ..... 101/486
4,890,553 A 1/1990 Turner ..... 101/389.1
5,678,487 A 10/1997 Guaraldi et al. ..... 101/415.1
6,062,140 A 5/2000 McEachern ..... 101/389.1
6,199,280 B1 * 3/2001 Schneider et al. ..... 29/895.211
6,443,067 B2 * 9/2002 Kimura ..... 101/415.1

FOREIGN PATENT DOCUMENTS

| | | |
|---|---|---|
| DE | 1001324 | 7/2001 |
| DE | 1001328 | 7/2001 |
| JP | 20011253051 | 9/2001 |

* cited by examiner

*Primary Examiner*—Leslie J. Evanisko
(74) *Attorney, Agent, or Firm*—Davidson, Davidson & Kappel, LLC

(57) ABSTRACT

A tucking device for tucking a printing plate into a gap of a plate cylinder includes a tucker bar having a tucking surface and at least one magnet for creating a repulsive magnetic force at the tucking surface. An actuator connected to the tucker bar is used for moving the tucker bar to tuck the printing plate into the gap.

11 Claims, 2 Drawing Sheets

METHOD FOR MAGNETICALLY TUCKING A PRINTING PLATE INTO A PLATE CYLINDER

BACKGROUND OF THE INVENTION

The present invention relates generally to printing presses and more particularly to a method for tucking an edge of a plate into a plate cylinder of a printing press.

U.S. Pat. No. 5,678,487 discloses an apparatus for mounting printing plates into an axially-extending gap in a plate cylinder. A tucking device has a plurality of tucking elements arranged along the width of the plate cylinder and its axially extending gap. Each of the tucking elements is driven by pistons, so that a plurality of pistons extend along the width of the tucking device. The '487 patent is hereby incorporated by reference herein.

German Patent Application Nos. 100 01 324 and 100 01 328 disclose a device for pulling flexible printing plates onto a plate cylinder using a pressure roller. In the '324 application, the pressure on an edge of the printing plate is less than in the middle, while in the '328 application the pressure roller has a camber and is activated by adjustable pressure forces.

U.S. Pat. No. 4,890,553 discloses a positioning and attachment means for flexible printing plates on a plate cylinder. Register pins and a permanent bar magnet are mounted to the plate cylinder. The bar magnet is located inside the plate and is advanced to hold a leading edge of the plate. A stationary bar magnet can hold the trailing edge.

U.S. Pat. No. 6,062,140 discloses a magnetic plate cylinder having permanent bar magnets at a circumference of the plate cylinder for holding the printing plate on the plate cylinder.

Japanese Patent Application No. 2001-253051 discloses a printing plate having a permanent magnetic layer for fastening the plate to the plate cylinder.

BRIEF SUMMARY OF THE INVENTION

A problem associated with present tucking devices is that a large number of pistons or air cylinders are needed across the width of the tucking device to properly tuck the tail of the plate into the slot of the plate cylinder.

An object of the present invention is to provide a simplified tucking method. Another alternate or additional object of the present invention is to provide a tucking method using fewer moving parts. Yet a further alternate or additional object of the present invention is to improve access inside a print unit of a printing press having a tucking device.

The present invention provides a tucking device for tucking a printing plate into a gap of a plate cylinder comprising:

- a tucker bar, the tucker bar having a tucking surface and at least one magnet for creating a repulsive magnetic force at the tucking surface; and
- an actuator connected to the tucker bar for moving the tucker bar.

By having a magnet on the tucker bar creating a repulsive force away from the tucker bar, the magnetic force can aid in the tucking motion, and moving parts can be reduced.

Preferably, the actuator includes a first cylinder at one end of the tucker bar, and a second cylinder at another end of the tucker bar, with the magnet being located between the first cylinder and the second cylinder.

The first and second cylinders may be held by brackets attached to a frame of the printing press.

Alternately, the actuator may include handles for an operator to hold and control the tucker bar.

The magnets may be electrically-activated or permanent.

The present invention also provides a method for attaching a printing plate having a first side and a second side to a plate cylinder comprising the steps of:

- attaching a first edge of the printing plate in a gap of the plate cylinder;
- placing the printing plate on the plate cylinder so that the first side of the printing plate lies on an outer circumferential surface of the plate cylinder; and
- tucking a second edge of the printing plate into the gap or another gap of the plate cylinder using a repulsive magnetic force against the second side of the printing plate.

The placing of the printing plate may occur for example through rotation of the plate cylinder.

Preferably, the tucking also includes forcing the second side of the printing plate using a tucker bar contacting the second side.

DETAILED DESCRIPTION OF THE PREFERRED EMBODIMENTS

Figure 1:
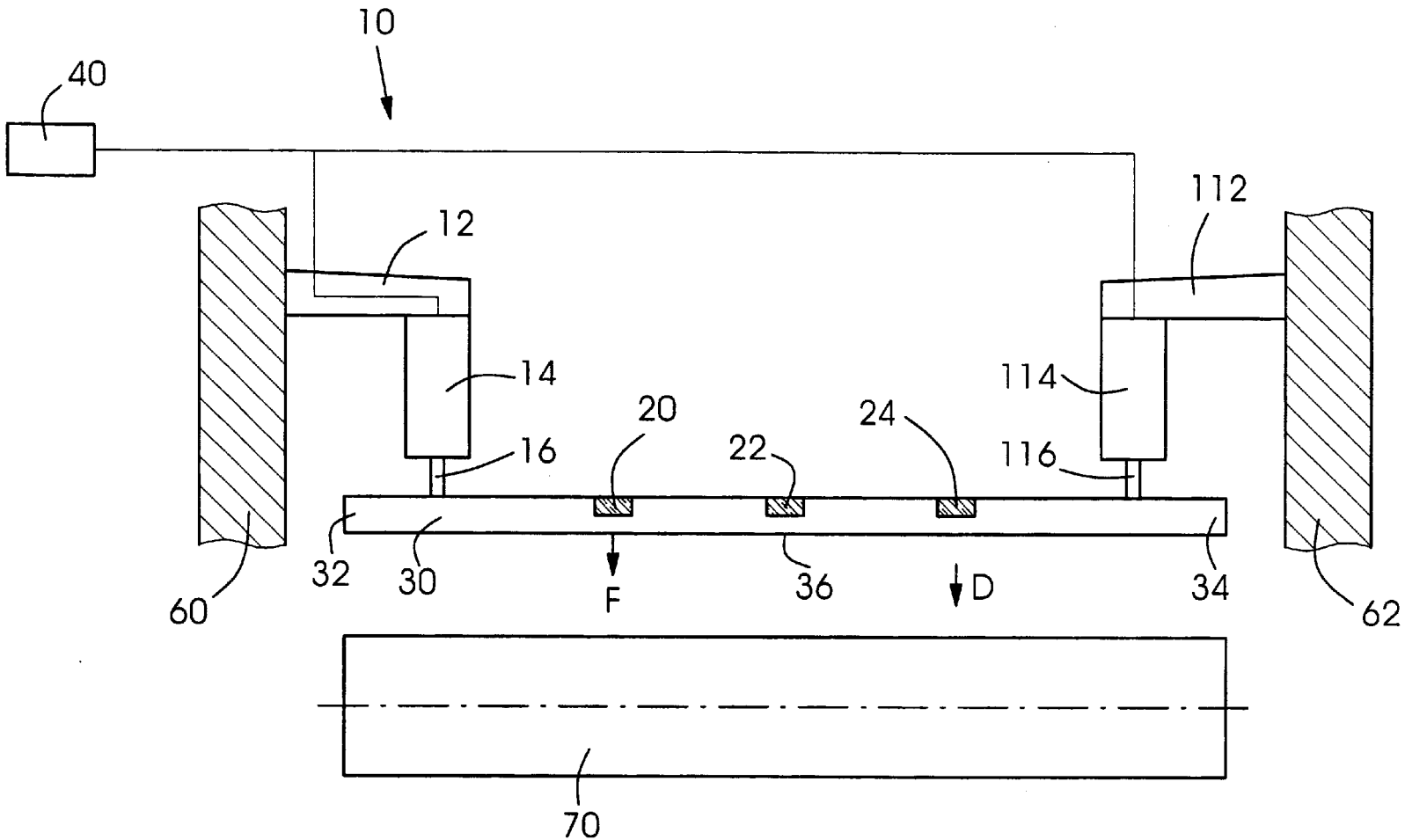
FIG. 1 shows a preferred embodiment of the tucking device of the present invention.

FIG. 1 shows a first embodiment of a tucking device 10 according to the present invention. Tucking device 10 includes a tucker bar 30 connected at one end 32 to a piston 16 of an air cylinder 14, and at the other end 34 to a piston 116 of an air cylinder 114. Air cylinder 14 is connected to a work side frame 60 of a printing press by a fixed bracket 12, and air cylinder 114 is connected to a gear side frame 62 of the printing press via a fixed bracket 112.

Air cylinders 14, 114 are driven in tandem by a controller 40, which can actuate bar 30 in direction D towards a plate cylinder 70. Plate cylinder 70 is rotatable with respect to frames 60, 62.

Magnets 20, 22, 24, which may be for example permanent or electrically-activated magnets, are located between the ends 32, 34 of the bar 30, and create a magnetic repulsive force F normal to the lower or tucking surface 36 of the tucker bar 30.

The magnetic force added to the force created by the air cylinders provides an improved tucker bar. The magnetic force results in less force being required by the air cylinders, and a reduced stiffness requirement for the tucker bar. Smaller or fewer moving parts are required for the tucking device, so that access to the printing unit also can be improved.

Figure 2:
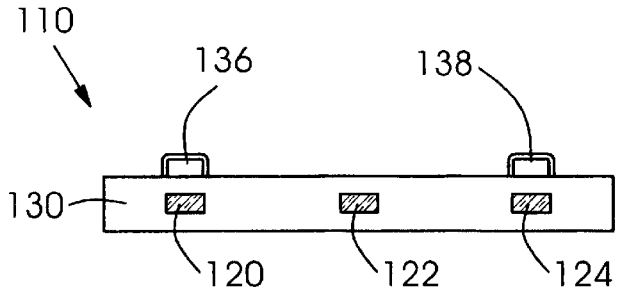
FIG. 2 shows an alternate embodiment of the tucking device of the present invention.

FIG. 2 shows an alternate embodiment with an operator-held tucking device 110. Tucker bar 130 with repulsive force magnets 120, 122, 124 has two handles 136, 138. An operator thus can grip the tucking device at handles 136, 138 and use the bar to tuck a printing plate manually.

Figure 3:
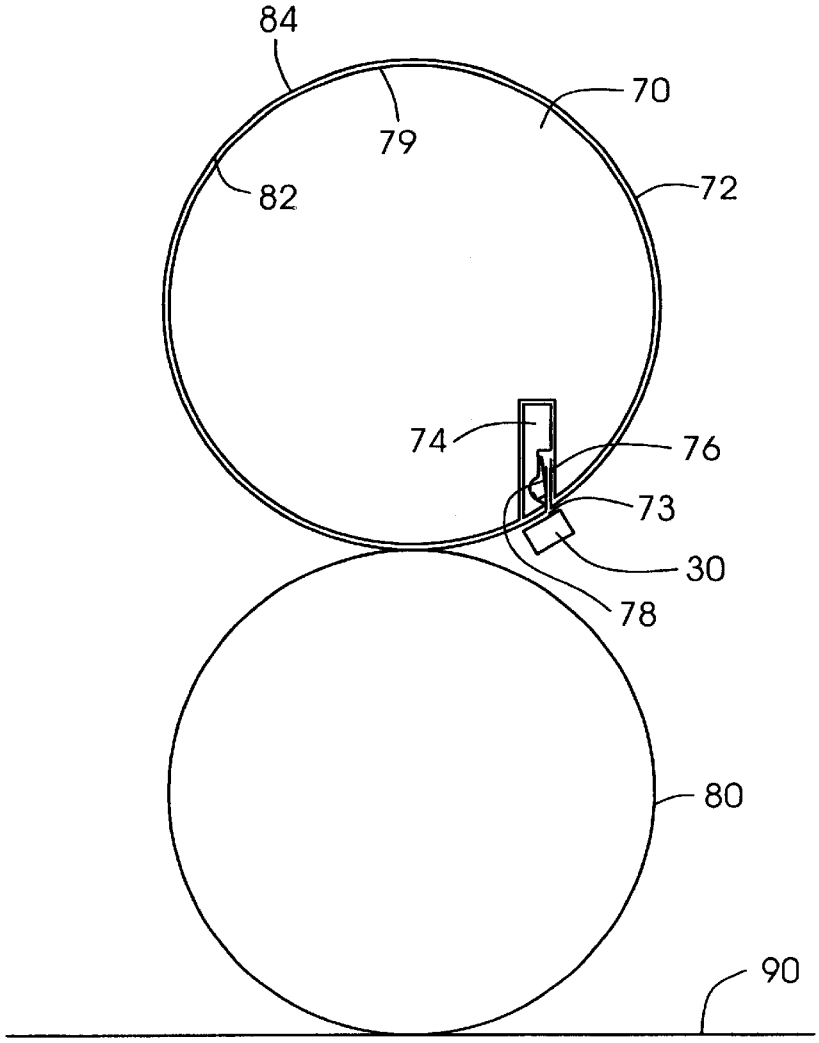
FIG. 3 shows a cross-sectional view of the tucking device tucking a printing plate into a gap of a plate cylinder.

FIG. 3 shows a cross-section of tucker bar 30 of tucking device 10 tucking a printing plate 72 onto plate cylinder 70. Plate cylinder 70 may be part of an offset lithographic printing press having a blanket cylinder 80 for printing a web 90.

A lead edge 76 of printing plate 72 first is tucked into a gap 73 in the outer circumference 79 of plate cylinder 70. Plate cylinder 70 is then rotated so that an inner side 82 of printing plate 72 contacts outer surface 79. Trail edge 78 of printing plate 72 thus lines up with gap 73. Tucker bar 30 tucks the trail edge 78 into gap 73 using physical and repulsive magnetic forces acting on an outer side 84 of plate 72. A lock-up device 74 then secures both edges 76, 78 to the plate cylinder 70.

While the use of a one-around plate cylinder is shown, the tucker bar 30 could be used to tuck the trail edge 78 into another gap on the plate cylinder, for example, when a two-or-more around plate cylinder is used.

What is claimed is:

1. A method for attaching a printing plate having a first side and a second side to a plate cylinder comprising the steps of:

attaching a first edge of the printing plate in a gap of the plate cylinder;

placing the printing plate on the plate cylinder so that the first side of the printing plate lies on an outer circumferential surface of the plate cylinder; and tucking a second edge of the printing plate into the gap or another gap of the plate cylinder using a repulsive magnetic force against the second side of the printing plate.

2. The method as recited in claim 1 wherein the placing step includes rotating the plate cylinder.

3. The method as recited in claim 1 wherein the tucking step includes contacting the second side of the printing plate with a tucker bar.

4. The method as recited in claim 3 wherein repulsive magnetic force is created by at least one magnet on the tucker bar.

5. The method as recited in claim 4 wherein the tucking step includes actuating the tucker bar with an actuator connected to the tucker bar.

6. The method as recited in claim 5 wherein the actuating includes moving a first cylinder at one end of the tucker bar, and moving a second cylinder at another end of the tucker bar, with the at least one magnet being located between the first cylinder and the second cylinder.

7. The method as recited in claim 6 further comprising supporting the first and second cylinders using brackets.

8. The method as recited in claim 5 further comprising manually holding and controlling the tucker bar via handles.

9. The method as recited in claim 4 further comprising electrically-activating the at least one magnet.

10. The method as recited in claim 4 wherein the at least one magnet is a permanent magnet.

11. The method as recited in claim 4 wherein the at least one magnet includes a plurality of magnets.

* * * * *